US007410744B2

(12) United States Patent
Watanabe et al.

(10) Patent No.: US 7,410,744 B2
(45) Date of Patent: Aug. 12, 2008

(54) RECORDING METHOD

(75) Inventors: Tsutomu Watanabe, Shizuoka-ken (JP); Toshio Hara, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 64 days.

(21) Appl. No.: 11/607,943

(22) Filed: Dec. 4, 2006

(65) Prior Publication Data

US 2007/0128542 A1 Jun. 7, 2007

(30) Foreign Application Priority Data

Dec. 2, 2005 (JP) ..... 2005-349537

(51) Int. Cl.
*G03C 5/16* (2006.01)

(52) U.S. Cl. ..... 430/138; 430/332; 430/964

(58) Field of Classification Search ..... 430/138, 430/332, 964
See application file for complete search history.

(56) References Cited

U.S. PATENT DOCUMENTS 5,409,797 A * 4/1995 Hosoi et al. ..... 430/138

FOREIGN PATENT DOCUMENTS

| | | | |
|---|---|---|---|
| JP | 7-257042 | A | 10/1995 |
| JP | 9-175035 | A | 7/1997 |
| JP | 2002-347344 | A | 12/2002 |

* cited by examiner

*Primary Examiner*—Richard Schilling
(74) *Attorney, Agent, or Firm*—Sughrue Mion, PLLC

(57) ABSTRACT

According to an aspect of the invention, there is provided a method of recording an image, including irradiating a $CO_2$ laser having a wavelength of from 9 to 11 μm onto a recording material in which a recording layer and a protective layer are provided on a support in this order, wherein the recording layer includes at least microcapsules encapsulating a basic dye precursor, and the protective layer includes a binder.

13 Claims, No Drawings

RECORDING METHOD

CROSS-REFERENCE TO RELATED APPLICATION

This application claims priority under 35 USC 119 from Japanese Patent Application No. 2005-349537, the disclosure of which is incorporated by reference herein.

BACKGROUND OF THE INVENTION

1. Field of the Invention

The present invention relates to an image recording method, and more particularly to a recording method of recording an image in a recording material that forms a color by irradiation of a laser beam.

2. Description of the Related Art

On beverage cans, beverage containers, food containers, medicine containers, cosmetics containers, packaging materials, electronic components, electric parts, automotive components and the like (hereinafter referred to as "containers"), a manufacturing lot number, manufacturing date, model, name of manufacturer and the like are, for example, marked by characters, symbols, marks, patterns, barcodes or the like (hereinafter referred to as "marks").

As marking methods, a method of directly printing a colored printing ink on containers by pad printing, screen printing, an ink jet method or the like, and a method of attaching labels having marks printed thereon are used. In the direct printing method, however, printing may be difficult depending on the shape of the container to be printed on, and in the method of attaching printed labels, a wide variety of labels must be prepared for respective types of marks.

To solve these problems, recently, laser marking methods have come to be used in which a laser marking layer including a color former and a developer is provided on containers, and a laser beam is irradiated to the layer to cause a chemical reaction to form a color (see, for example, Japanese Patent Application Laid-Open (JP-A) Nos. 7-257042, 2002-347344, and 9-175035). This method is superior in productivity to the previous methods and thus is suitable for forming marks on containers.

In the laser marking method, however, when printing a label coated with a laser marking layer, the label may be colored by the solvent of the printing ink, or when a container to which a label is attached is heated for sterilization, a color may be formed. As a result, if a laser is irradiated to form a color after this, clear marks may not be obtained, so that the commercial value is reduced.

SUMMARY OF THE INVENTION

The present invention has been made in view of the above circumstances and provides a recording method.

According to an aspect of the invention, there is provided a method of recording an image, comprising irradiating a $CO_2$ laser having a wavelength of from 9 to 11 μm onto a recording material in which a recording layer and a protective layer are provided on a support in this order, wherein the recording layer comprises at least microcapsules encapsulating a basic dye precursor, and the protective layer comprises a binder.

DETAILED DESCRIPTION OF THE INVENTION

The method of the present invention is a method of recording an image, comprising irradiating a $CO_2$ laser having a wavelength of from 9 to 11 μm onto a recording material in which a recording layer and a protective layer are provided on a support in this order, wherein the recording layer comprises at least microcapsules encapsulating a basic dye precursor, and the protective layer comprises a binder.

<Recording Layer>

The recording layer in the recording material that is used in the recording method of the invention contains at least a color-forming component, and may further contain other components as needed. One or two or more recording layers may be provided in the recording material.

Color-Forming Component

The color-forming component may be a component that has good transparency before heat treatment but quickly forms a color by heat treatment. Examples of the color-forming component include what is called two-component type color-forming components, which contains a substantially colorless color-forming component A and a substantially colorless color-forming component B that reacts with the color-forming component A to form a color. In the invention, (a) a combination of a basic dye precursor and an electron-accepting compound may be used, wherein the basic dye precursor is encapsulated in microcapsules.

The recording material that is used in the recording method of the invention may further include other recording layers in addition to the recording layer containing (a) a basic dye precursor and an electron-accepting compound as color-forming components. In this case, examples of color-forming components A and B that is contained in the other recording layers include (a) a combination of a basic dye precursor and an electron-accepting compound, and further the following (a) to (m). The color-forming component A or B is preferably encapsulated in microcapsules from the viewpoints of storage stability and background fogging.

(a) a combination of a basic dye precursor and an electron-accepting compound;

(b) a combination of a photolytic diazo compound and a coupler;

(c) a combination of a metal salt of an organic acid such as silver behenate or silver stearate and a reducing agent such as protocathechinic acid, spiroindane or hydroquinone;

(d) a combination of a salt of a long-chain fatty acid such as a ferric salt of stearic acid or a ferric salt of myristic acid and a phenol such as gallic acid or ammonium salicylate;

(e) a combination of a heavy metal salt of an organic acid such as a nickel, cobalt, lead, copper, iron, mercury or silver salt of acetic acid, stearic acid or palmitic acid and an alkali earth metal sulfide such as calcium sulfide, strontium sulfide or potassium sulfide, or a combination of such a heavy metal salt of an organic acid and an organic chelate agent such as s-diphenylcarbazide or diphenylcarbazone;

(f) a combination of a (heavy) metal sulfide such as silver sulfide, lead sulfide, mercury sulfide or sodium sulfide and a sulfur compound such as Na-tetrathionate, sodium thiosulfate, or thiourea;

(g) a combination of a ferric salt of a fatty acid such as a ferric salt of stearic acid and an aromatic polyhydroxy compound such as 3,4-dihydroxytetraphenylmethane;

(h) a combination of a noble metal salt of an organic acid such as silver oxalate or mercury oxalate and an organic polyhydroxy compound such as polyhydroxyalcohol, glycerin or glycol;

(i) a combination of a ferric salt of a fatty acid such as a ferric salt of pelargonic acid or a ferric salt of lauric acid and a thiocetylcarbamide or isothiocetylcarbamide derivative;

(j) a combination of a lead salt of an organic acid such as lead caprate, lead pelargonate, or lead behenate and a thiourea derivative such as ethylenethiourea or N-dodecylthiourea;

(k) a combination of a heavy metal salt of a higher fatty acid such as a ferric salt of stearic acid or copper stearate and zinc dialkyldithiocarbamate;

(l) a combination forming an oxazine dye, such as a combination of resorcin and a nitroso compound; and (m) a combination of a formazan compound and (a reducing agent and/or a metal salt).

Among these combinations, as the color-forming components in the other recording layers, the following are preferable: (a) the combination of a basic dye precursor and an electron-accepting compound, (b) the combination of a photolytic diazo compound and a coupler, or (c) the combination of a metal salt of an organic acid and a reducing agent. The combination (a) or (b) is more preferable.

By forming a recording layer such that a low haze value (%) (calculated from the equation [(diffuse transmittance/total light transmittance)×100]) is obtained, the recording material that is used in the invention can form an image excellent in transparency. The haze value is an index representing the transparency of material, and is generally calculated from total transmission light amount, diffused transmission light amount, and parallel transmission light amount, using a haze meter.

In the invention, the haze value can be decreased, for example, by making the color-forming components A and B in the recording layer have a 50%-volume average particle diameter of 1.0 μm or less, preferably 0.6 μm or less and making a binder be contained in the recording layer in an amount of 30 to 60% by mass of the total solid content of the recording layer; or by microencapsulating one of the color-forming components A and B and making the other component be present in a form of a substantially continuous layer, for example, in a form of an emulsified dispersion, after application and drying thereof. To make the components used in the recording layer have the same refractive index as possible is also effective.

In the specification, the 50%-volume average particle diameter refers to the average particle diameter at which the cumulative volume distribution of the particles reaches 50%, this diameter being measured with a laser diffraction particle diameter distribution meter (trade name: LA700, manufactured by Horiba Ltd.) and being referred to merely as the "average particle diameter" on occasion hereinafter.

The following will describe the above-mentioned combination (a), (b) and (c), which are preferably used in the recording layer, in detail hereinafter.

(a) Combination of a Basic Dye Precursor and an Electron-Accepting Compound

The basic dye precursor which is used in the invention may be any basic dye precursor that is substantially colorless, but not limited thereto. The precursor may have a nature of donating an electron to form a color or accepting a proton from an acid to form a color, and is preferably a colorless compound having a partial skeleton of lactone, lactam, sultone, spiropyran, ester, amide or the like, the skeleton being opened or cleaved when the compound contacts with an electron-accepting compound.

Examples of the basic dye precursor include triphenylmethanephthalide compounds, fluorane compounds, phenothiazine compounds, indolylphthalide compounds, leuco auramine compounds, rohdamine lactam compounds, triphenylmethane compounds, triazene compounds, spiropyran compounds, fluorene compounds, pyridine compounds and pyrazine compounds.

Specific examples of the triphenylmethanephthalide compounds include compounds described in U.S. Reissued Pat. No. 23,024, and U.S. Pat. Nos. 3,491,111, 3,491,112, 3,491,116, and 3,509,174, the disclosures of which are incorporated by reference herein.

Specific examples of the fluorane compounds include compounds described in U.S. Pat. Nos. 3,624,107, 3,627,787, 3,641,011, 3,462,828, 3,681,390, 3,920,510, and 3,959,571, the disclosures of which are incorporated by reference herein.

Specific examples of the spiropyran compounds include compounds described in U.S. Pat. No. 3,971,808, the disclosures of which are incorporated by reference herein.

Specific examples of the pyridine compounds and the pyrazine compounds include compounds described in U.S. Pat. Nos. 3,775,424, 3,853,869 and 4,246,318, the disclosures of which are incorporated by reference herein.

Specific examples of the fluorene compounds include compounds described in JP-A No 63-094878, the disclosure of which is incorporated by reference herein.

Among these compounds, a particularly preferable example is 2-arylamino-3-[H, halogen, alkyl or alkoxy-6-substituted aminofluorane], which forms black color.

Specific examples thereof include 2-anilino-3-methyl-6-diethylaminofluorane, 2-anilino-3-methyl-6-N-cyclohexyl-N-methylaminofluorane, 2-p-chloroanilino-3-methyl-6-dibutyl amino fluorane, 2-anilino-3-methyl-6-dioctylaminofluorane, 2-anilino-3-chloro-6-diethylaminofluorane, 2-anilino-3-methyl-6-N-ethyl-N-isoamylaminofluorane, 2-anilino-3-methyl-6-N-ethyl-N-dodecylaminofluorane, 2-anilino-3-methoxy-6-dibutylaminofluorane, 2-o-chloroanilino-6-dibutylaminofluorane, 2-p-chloroanilino-3-ethyl-6-N-ethyl-N-isoamylaminofluorane, 2-o-chloroanilino-6-p-butylanilinofluorane, 2-anilino-3-pentadecyl-6-diethylaminofluorane, 2-anilino-3-ethyl-6-dibutylaminofluorane, 2-o-toluidino-3-methyl-6-diisopropylaminofluorane, 2-anilino-3-methyl-6-N-isobutyl-N-ethylaminofluorane, 2-anilino-3-methyl-6-N-ethyl-N-tetrahydrofurfurylaminofluorane, 2-anilino-3-chloro-6-N-ethyl-N-isoamylaminofluorane, 2-anilino-3-methyl-6-N-methyl-N-γ-ethoxypropylaminofluorane, 2-anilino-3-methyl-6-N-ethyl-N-γ-ethoxypropylaminofluorane, and 2-anilino-3-methyl-6-N-ethyl-N-γ-propoxypropylaminofluorane.

Examples of the electron-accepting compound which reacts with the basic dye precursor include acidic compounds such as phenol compounds, organic acids or metal salts thereof, and oxybenzoic acid esters. Compounds described in JP-A No. 61-291183, the disclosure of which is incorporated by reference herein, are specific examples thereof.

More specific examples thereof include bisphenol compounds such as 2,2-bis(4'-hydroxyphenyl)propane [common name: bisphenol A], 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methyl-pentane, 1,1-bis(4'-hydroxyphenyl)-

2-ethyl-hexane, 1,1-bis(4'-hydroxyphenyl)dodecane, 1,4-bis(p-hydroxyphenylcumyl)benzene, 1,3-bis(p-hydroxyphenylcumyl)benzene, bis(p-hydroxyphenyl)sulfone, bis(3-allyl-4-hydroxyphenyl)sulfone, and bis(p-hydroxyphenyl)benzyl acetate ester;

salicylic acid derivatives such as 3,5-di-α-methylbenzylsalicylic acid, 3,5-di-tert-butylsalicylic acid, -3α-α-dimethylbenzylsalicylic acid, and 4-(β-p-methoxyphenoxyethoxy)salicylic acid;

polyvalent metal salts of the salicylic acid derivatives (preferably, zinc and aluminum salts of the salicylic acid derivatives);

oxybenzoic acid esters such as benzyl p-hydroxybenzoate, 2-ethylhexyl p-hydroxybenzoate, and β-resorcylic acid-(2-phenoxyethyl)ester; and phenols such as p-phenylphenol, 3,5-diphenylphenol, cumylphenol, 4-hydroxy-4'-isopropoxy-diphenylsulfone, and 4-hydroxy-4'-phenoxy-diphenylsulfone.

The bisphenol compounds are particularly preferable since they give a satisfactory color forming property. A single kind of the electron-accepting compound may be used or a multiple kinds of the electron-accepting compounds may be simultaneously used.

(b) Combination of a Photolytic Diazo Compound and a Coupler

The photolytic diazo compound is a compound which reacts (coupling reaction) with a coupler, which is a coupling component that will be detailed later, so as to form a desired color, and has a photolytic property so that the compound decomposes upon receiving light having a specific wavelength before the reaction whereby the compound loses color-forming ability any longer even in the presence of the coupling component.

The hue by this color-forming system is determined by the diazo dye generated by the reaction between the photolytic diazo compound and the coupler. Accordingly, by changing the chemical structure of the photolytic diazo compound or the coupler, the hue can be changed easily. Arbitrary hue can be obtained by appropriate selection of the combination.

A photolytic diazo compound preferably used in the invention is an aromatic diazo compound, specific examples of which include aromatic diazonium salts, diazosulfonate compounds and diazoamino compounds.

Examples of the aromatic diazonium salts include the compounds represented by:

$$Ar—N_2^+.X^-$$

wherein Ar represents a substituted or unsubstituted aromatic hydrocarbon cyclic group, $N_2^+$ represents a diazonium group, and $X^-$ represents an acid anion. The aromatic diazonium salts are not limited to the examples. Preferably, an aromatic diazonium salt that is used has excellent photo-fixability, rarely causes occurrence of colored stain after fixation, and provides image whose colored portions are stable.

A number of diazosulfonate compounds have been known in recent years. The compounds are obtained by treating various diazonium salts with a sulfite, and can be preferably used in the recording materials in the invention.

The diazoamino compounds can be obtained by coupling a diazo group with dicyan diamide, sorcosine, methyltaurine, N-ethylanthranic acid-5-sulfonic acid, monoethanolamine, diethanolamine, guanidine, or the like, and can be preferably used in the recording materials in the invention.

Details of these diazo compounds are described, for example, in JP-A No. 2-136286, the disclosure of which is incorporated by reference herein.

Examples of the coupler which reacts (coupling reaction) with the above-mentioned photolytic diazo compound include 2-hydroxy-3-naphthoic acid anilide, resorcin, and the compounds described in JP-A No. 62-146678, the disclosure of which is incorporated by reference herein.

If the above-mentioned combination of a photolytic diazo compound and a coupler is used in the other recording layers, a basic substance as a sensitizer may be included in the layers, since the coupling reaction can be further promoted if the reaction is conducted in a basic environment.

Examples of the basic substance include water-insoluble or slightly water-soluble basic materials and materials which generate alkali by heat. Examples thereof include nitrogen-containing compounds such as inorganic or organic ammonium salts, organic amines, amides, urea and thiourea or derivatives thereof, thiazoles, pyrroles, pyrimidines, pyperazines, guanidines, indoles, imidazoles, imidazolines, triazoles, morpholines, piperidines, amidines, formazines, and pyridines.

Specific examples thereof include the basic substances described in JP-A No. 61-291183, the disclosure of which is incorporated by reference herein.

(c) Combination of an Organic Metal Salt and a Reducing Agent

Specific examples of the organic metal salt include silver salts of long-chain aliphatic carboxylic acids, such as silver laurate, silver myristate, silver palmitate, silver stearate, silver arachate, and silver behenate; silver salts of organic compounds each having an imino group, such as benzotriazole silver salts, benzimidazole silver salts, carbazole silver salts and phthalazinone silver salts; silver salts of sulfur-containing compounds, such as s-alkylthioglycolate; silver salts of aromatic carboxylic acids, such as silver benzoate and silver phthalate; silver salts of sulfonic acids, such as silver ethansulfonate; silver salts of sulfinic acids, such as silver o-toluenesulfinate; silver salts of phosphoric acid, such as silver phenylphosphate; silver baribiturate, silver saccharate, and silver salts of salicylasdoxime; and mixtures thereof.

Among these examples, silver salts of long-chain aliphatic carboxylic acids are preferable. In particular, silver behenate is more preferable. Behenic acid may be used together with silver behenate.

As the reducing agent, one or more selected from the compounds described in JP-A No. 53-1020, page 227, lower-left column, line 14 to page 229, upper-right column, line 11 can be appropriately used. In particular, the following can be preferably used: mono-, bis-, tris- or tetrakis-phenols, mono- or bis-naphthols, di- or poly-hydroxynaphthalenes, di- or poly-hydroxybenzenes, hydroxy monoethers, ascorbic acids, 3-pyrazolidones, pyrazolines, pyrazolones, reducing sugars, phenylenediamines, hydroxylamines, reductones, hydroxamines, hydrazides, amideoximes, and N-hydroxyureas.

Among these examples, aromatic organic reducing agents such as polyphenols, sulfonamidephenols, and naphthols are more preferable.

In order to keep the transparency of the recording material sufficiently, it is preferable that the combination (a) of a basic dye precursor and an electron-accepting compound, or the combination (b) of a photolytic diazo compound and a coupler is used in the other recording layers. It is also preferable in the invention that any one of the color-forming components A and B is encapsulated in microcapsules and used. It is more preferable that the basic dye precursor or the photolytic diazo compound is encapsulated in microcapsules and used.

(Microcapsules)

The process for producing the microcapsules will be described in detail hereinafter.

The interfacial polymerization method, the internal polymerization method, and the external polymerization method are known as methods for producing microcapsules. Any one thereof may be employed.

As described above, the recording material that is used in the invention includes a recording layer containing microcapsules encapsulating a basic dye precursor. When the recording material further includes the other recording layers, a basic dye precursor or a photolytic diazo compound is preferably encapsulated in microcapsules. It is particularly preferable to employ the interfacial polymerization method which comprises the step of mixing an oil phase prepared by dissolving or dispersing the basic dye precursor or the photolytic diazo compound, which will be cores of capsules, in a hydrophobic organic solvent with a water phase comprising a dissolved water-soluble polymer, the step of emulsifying the mixture by means of a homogenizer or the like, and the step of heating the emulsion to cause a polymer forming reaction at the interface between the oil droplets and water, thereby forming microcapsule walls made of a polymer material.

The wall materials for making the polymer material are added to the inside and/or the outside of the oil droplets. Specific examples of the polymer material include polyurethane, polyurea, polyamide, polyester, polycarbonate, urea-formaldehyde resin, melamine resin, polystyrene, and styrene-methacrylate copolymer, styrene-acrylate copolymer. Among these polymers, polyurethane, polyurea, polyamide, polyester, and polycarbonate are preferable. Polyurethane and polyurea are more preferable.

For example, if polyurea is used for the material of the capsule walls, the microcapsule walls can easily be formed by allowing a polyisocyanate such as a diisocyanate, triisocyanate, tetraisocyanate or polyisocyanate prepolymer to react with a polyamine such as a diamine, triamine or tetraamine, a prepolymer having 2 or more amino groups, piperazine or a derivative thereof, or a polyol in the above-mentioned water phase by the interfacial polymerization method.

For example, composite walls composed of polyurea and polyamide, or composite walls composed of polyurethane and polyamide can be prepared by incorporating polyisocyanate and a second material which reacts with the polyisocyanate to form capsule walls (for example, acid chloride, polyamine or polyol) into an aqueous solution (water phase) of a water-soluble polymer or an oil medium (oil phase) to be encapsulated, emulsifying the mixture, and heating the resultant emulsion. Details of this method of producing the composite walls made of polyurea and polyamide are described in JP-A No. 58-66948, the disclosure of which is incorporated by reference herein.

In the invention, the capsule wall material preferably contains at least an isophorone diisocyanate compound. By forming the microcapsule by using a wall material containing an isophorone diisocyanate compound, the capsule wall is made hydrophobic, water adsorption at high humidity is decreased, and water desorption at low humidity is decreased, whereby the ambient humidity dependence of the thermal response of the microcapsule is decreased. As a result, the ambient humidity dependence of the sensitivity of the recording material is decreased.

As mentioned above, the capsule wall material preferably contains at least an isophorone diisocyanate compound. The wall material preferably contains an isophorone diisocyanate compound as a main component (the content in the wall material being 50% by mass or more), and the content of a material derived from isophorone diisocyanate is preferably 50% by mass or more. The isophorone diisocyanate compound may be either monomer or multimer of isophorone diisocyanate, and trimer is particularly preferred. A mixture of dimer and trimer of isophorone diisocyanate is also preferably used as a wall material, and the rate of trimer is preferably 20% by mass or more and more preferably 50% by mass or more in the total weight of the capsule wall material.

In a range not impeding the effect of decreasing the ambient humidity dependence of the sensitivity of the recording material, in addition to the isophorone diisocyanate compound, other monomers or prepolymers may be used, whereby various highly hydrophobic microcapsules may be formed. It is preferable that, as the other monomers or prepolymers, a polyamine, a prepolymer having two or more amino groups, piperazine or its derivative, or a polyol may be used in combination with the above-mentioned isophorone diisocyanate monomer and/or multimer to form microcapsules of a polyurea or polyurethane.

In a range not impeding the effect of decreasing the ambient humidity dependence of the sensitivity of the recording material, in addition to the isophorone diisocyanate compound, other polyisocyanate compounds may be used. Other polyisocyanate compounds are preferably compounds having three or more isocyanate groups. However, a compound having three or more isocyanate group may be used in combination with a compound having two isocyanate groups, or a compound having two isocyanate groups may be used alone. Specific examples include xylene diisocyanate and a hydrate thereof, hexamethylene diisocyanate, trilene diisocyanate and a hydrate thereof; a dimer or trimer (biuret or isocyanurate) of a diisocyanate such as isophorone diisocyanate; a multifunctional adduct of a polyol such as trimethylol propane and a difunctional isocyanate such as xylene diisocyanate; a compound prepared by introducing a high molecular compound such as polyether having an active hydrogen such as polyethylene oxide into an adduct of a polyol such as trimethylol propane and a difunctional isocyanate such as xylene diisocyanate; and a formalin condensate of benzene isocyanate.

Other preferred examples include compounds disclosed in JP-A Nos. 62-212190, 4-26189 and 5-317694, and Japanese Patent Application No. 8-268721, the disclosures of which are incorporated by reference herein.

The isophorone diisocyanate compound is preferably added such that the average particle diameter of the microcapsules is from 0.3 to 12 μm and the thickness of the capsule walls is from 0.01 to 0.3 μm. The size of the dispersed particle is generally from about 0.2 to 10 μm.

Specific examples of the polyol and/or the polyamine, which is added to the water phase and/or the oil phase as one of the components that react with a polyisocyanate to form a microcapsule wall, include propylene glycol, glycerin, trimethylolpropane, triethanloamine, sorbitol, and hexamethylenediamine. When a polyol is added thereto, polyurethane walls are formed. In the above-mentioned reaction, it is preferable to keep the reaction temperature high or add an appropriate polymerization catalyst in order to increase the reaction velocity.

The polyisocyanate, the polyol, the reaction catalyst, the polyamine for forming a part of capsule walls, and the like are described in detail in *Polyurethane Handbook*, edited by Keiji Iwata and published by the Nikkan Kogyo Shimbun, Ltd. (1987), the disclosure of which is incorporated by reference herein.

If necessary, a charge adjusting agent such as a metal-containing dye or nigrosin, or any other additive may be added to the microcapsule walls. These additives can be added at the time of forming the walls, or at any other time, to be incorporated in the walls of the capsules. If necessary, a monomer such as a vinyl monomer may be graft-polymerized in order to adjust the charging property of the surfaces of the capsule walls.

In order to make microcapsule walls having excellent substance-permeability and color-formability even at lower temperatures, it is preferable to use a plasticizer suitable for the polymer used as the wall material. The plasticizer preferably has a melting point of 50° C. or more but 120° C. or less. It is particularly preferable to select a plasticizer which has such a melting point and takes a solid form at ordinary temperature.

For example, when the wall material is polyurea or polyurethane, it is preferable to use a hydroxy compound, a carbamic acid ester compound, an aromatic alkoxy compound, an organic sulfonamide compound, an aliphatic amide compound, an arylamide compound or the like, as a plasticizer.

When the oil phase is prepared, it is preferable to use an organic solvent having a boiling point of 100 to 300° C. as a hydrophobic organic solvent in which the basic dye precursor or the photolytic diazo compound is dissolved for forming cores of microcapsules.

Specific examples thereof include esters, dimethylnaphthalene, diethylnaphthalene, diisopropylnaphthalene, dimethylbiphenyl, diisopropylbiphenyl, diisobutylbiphenyl, 1-methyl-1-dimethylphenyl-2-phenylmethane, 1-ethyl-1-dimethylphenyl-1-phenylmethane, 1-propyl-1-dimethylphenyl-1-phenylmethane, triallylmethane (such as tritoluylmethane and toluyldiphenylmethane), terphenyl compounds (such as terphenyl), alkyl compounds, alkylated diphenyl ether compounds (such as propyldiphenyl ether), hydrogenated terphenyl compounds (such as hexahydroterphenyl), and diphenyl ether. Among these examples, esters are particularly preferable from the viewpoints of the emulsification stability of the emulsion.

Examples of the esters include phosphate esters such as triphenyl phosphate, tricresyl phosphate, butyl phosphate, octyl phosphate and cresylphenyl phosphate; phthalic esters such as dibutyl phthalate, 2-ethylhexyl phthalate, ethyl phthalate, octyl phthalate, and butylbenzyl phthalate; dioctyl tetrahydrophthalate; benzoic esters such as ethyl benzoate, propyl benzoate, butyl benzoate, isopentyl benzoate, and benzyl benzoate; abietic esters such as ethyl abietate, and benzyl abietate; dioctyl adipate; isodecyl succinate; diocyl azelate; oxalic esters such as dibutyl oxalate and dipentyl oxalate; diethyl malonate; maleic esters such as dimethyl maleate, diethyl maleate, and dibutyl maleate; tributyl citrate; sorbic esters such as methyl sorbate, ethyl sorbate and butyl sorbate; sebacic esters such as dibutyl sebacate, and dioctyl sebacate; ethylene glycol esters such as formic monoester and diester, butyric monoester and diester, lauric monoester and diester, palmitic monoester and diester, stearic monoester and diester, and oleic monoester and diester; triacetin; diethyl carbonate; diphenyl carbonate; ethylene carbonate; propylene carbonate; boric esters such as tributyl borate and tripentyl borate.

Among them, it is preferable to use, as the organic solvent, tricresyl phosphate alone or in combination with other solvent(s) since the stability of the emulsion becomes most satisfactory. The above-mentioned oils may be used in any combination thereof, or the oil(s) may be used together with an oil other than the above-mentioned oils.

If the solubility of the basic dye precursor or the photolytic diazo compound, which is to be encapsulated, in the hydrophobic organic solvent is low, a low boiling point solvent in which the basic dye precursor or the photolytic diazo compound dissolves well may be used simultaneously as an auxiliary solvent. Preferable examples of the low boiling point solvent include ethyl acetate, isopropyl acetate, butyl acetate and methylene chloride.

In order to obtain a high density with small coating amount, as described in JP-A No. 4-101885, only a low boiling point solvent may be used as a solvent for forming capsules. In this case, the above-mentioned low boiling point solvent as an auxiliary solvent may be suitably used.

When the basic dye precursor or the photolytic diazo compound is included in the recording layer of the recording material, the content of the basic dye precursor is preferably from 0.1 to 5.0 g/m$^2$, more preferably from 1.0 to 4.0 g/m$^2$. The content of the photolytic diazo compound is preferably from 0.02 to 5.0 g/m$^2$, more preferably from 0.10 to 4.0 g/m$^2$ from the viewpoint of the color density thereof.

When the content of the basic dye precursor is within the above-mentioned range, a sufficient color density can be obtained. When each of the content of the basic dye precursor and the content of the photolytic diazo compound is 5.0 g/m$^2$ or less, a sufficient color density can be obtained and the transparency of the recording layer can be maintained.

The water phase may be an aqueous solution comprising a dissolved water-soluble polymer as a protective colloid. The above-mentioned oil phase is added to the water phase, and then the mixture is emulsified with a homogenizer or the like. The water-soluble polymer acts as a dispersing medium for achieving homogeneous dispersion easily and stabilizing the emulsified solution. A surfactant may be added to at least one of the oil phase and the water phase in order to achieve more homogenous and stable dispersion. As the surfactant, a well-known surfactant for emulsification can be used. The amount of the surfactant to be added is preferably from 0.1 to 5%, more preferably from 0.5 to 2% by mass of the amount of the oil phase.

As the surfactant added to the water phase, a surfactant which does not cause precipitation or aggregation caused by a reaction with the protective colloid is appropriately selected from anionic and nonionic surfactants.

Preferable examples of the surfactant include sodium alkylbenzenesulfonate, sodium alkylsulfate, sodium dioctyl sulfosuccinate, polyalkylene glycol (such as polyoxyethylene nonyl phenyl ether), acetylene glycol and the like.

The oil phase containing the above-mentioned components and the water phase containing the protective colloid and the surfactant can be emulsified by a known ordinary means for emulsifying fine particles, such as high-speed stirring means or ultrasonic wave dispersing means. Specific examples of the means include a homogenizer, a Manton-Gaulin, an ultrasonic wave disperser, a dissolver, or a Kdmill. In order to promote the reaction for forming capsule walls after the emulsification, it is preferable to heat the emulsion to a temperature of 30 to 70° C. In order to prevent the aggregation between the capsules during the reaction, it is preferable to add water to the reaction system so as to lower the probability of collision between the capsules, or perform stirring sufficiently.

During the capsule forming reaction, a dispersion agent for preventing aggregation may be newly added. With the advance of the polymerization reaction, generation of carbon dioxide is observed. The termination of the generation can be regarded as the end point of the capsule wall forming reaction. Usually, target microcapsules can be obtained by several hours reaction.

(Emulsion)

If the basic dye precursor and further the photolytic diazo compound are used as core materials to form microcapsules, the coupler compound can be solid-dispersed together with, for example, a water-soluble polymer, an organic base, and other color-forming auxiliary/auxiliaries, by means of a sand mill or the like before use. However, it is preferable to dissolve the coupler in a high boiling point organic solvent which is scarcely soluble or insoluble in water, then mix this solution with an aqueous polymer solution (water phase) containing, as a protective colloid, a surfactant and/or a water-soluble polymer, then emulsify the resultant mixture by means of a homogenizer or the like, then use the resulting emulsion. In this case, a low boiling point solvent may be used as a dissolving auxiliary if necessary.

The coupler and the organic base may be separately emulsified or may be mixed with each other, dissolved into a high boiling point organic solvent and emulsified. The size of the emulsified particle is preferably 1 μm or less.

The high boiling point organic solvent used in this case can be appropriately selected from the high boiling point oils described in JP-A No. 2-141279, the disclosure of which is incorporated by reference herein.

Among the oils, it is preferable to use esters from the viewpoint of the emulsification stability of the resultant emulsion. Among the esters, tricresyl phosphate is particularly preferable. The above oils may be used in any combination thereof, or the oil(s) may be used simultaneously with an oil other than the above oils.

The water-soluble polymer contained as the protective colloid can be appropriately selected from known anionic polymers, nonionic polymers and amphoteric polymers. The water-soluble polymer has a solubility in water of preferably 5% or more at a temperature at which the emulsification is conducted. Specific examples of the water-soluble polymer include: polyvinyl alcohol and modified products thereof, polyacrylic amide and derivatives thereof, ethylene-vinyl acetate copolymer; styrene-maleic anhydride copolymer; ethylene-maleic anhydride copolymer; isobutylene-maleic anhydride copolymer; polyvinyl pyrrolidone; ethylene-acrylic acid copolymer; vinyl acetate-acrylic acid copolymer; cellulose derivatives such as carboxymethylcellulose and methylcellulose; casein; gelatin; starch derivatives; gum arabic; and sodium alginate.

Among these polymers, polyvinyl alcohol, gelatin and cellulose derivatives are more preferable, and polyvinyl alcohol is particularly preferable.

The mixing ratio of the oil phase to the water phase (the mass of the oil phase/the mass of the water phase) is preferably from 0.02 to 0.6, more preferably from 0.1 to 0.4. When the mixing ratio is within the range of 0.02 to 0.6, the coating liquid has an appropriate viscosity, thus the production of the recording material is easier, and the stability of the coating liquid with time is superior.

When the electron-accepting compound is included in the recording material that is used in the invention, the amount of the electron-accepting compound is preferably from 0.5 to 30 parts by mass, more preferably from 1.0 to 10 parts by mass based on 1 part by mass of the basic dye precursor.

When the coupler is included in the recording material that is used in the invention, the amount of the coupler is preferably from 0.1 to 30 parts by mass and more preferably 0.5 to 10 parts by mass based on 1 part by mass of the photolytic diazo compound.

(Coating Liquid for Forming Recording Layer)

The coating liquid for forming the recording layer can be prepared, for example, by mixing the microcapsule solution and the emulsion prepared as described above. The water-soluble polymer used as a protective colloid during the preparation of the microcapsule solution and the water-soluble polymer used as a protective colloid during the preparation of the emulsion function as binders in the recording layer. A binder other than these protective colloids may preferably be further added during the preparation of the coating liquid for forming the recording layer.

Examples of the binder contained in the recording layer include hydroxyethylcellulose, hydroxypropylcellulose, epichlorohydrin-modified polyamide, ethylene-maleic anhydride copolymer, styrene-maleic anhydride copolymer, isobutylene-maleic anhydride-salicylic acid copolymer, polyacrylic acid, polyacrylic amide, methylol-modified polyacrylamide, starch derivatives, casein, and gelatin.

To the binders, an water-resistance imparting agent may be added in order to provide water resistance, and/or an emulsion of a hydrophobic polymer, specific examples of which include styrene-butadiene rubber latex and acrylic resin emulsion, may be added.

When the coating liquid for forming the recording layer is applied to a support, a known applying means used for water-based or organic solvent-based coating liquid is used. In this case, in order to apply the coating liquid for forming the recording layer safely and uniformly and assure the strength of the coating, at least one selected form the following can be included in the coating liquid for the recording material that is used in the invention: methylcellulose, carboxymethylcellulose, hydroxyethylcellulose, starch, gelatin, polyvinyl alcohol, polyacrylamide, polystyrene or copolymers thereof, polyester or copolymers thereof, polyethylene or copolymers thereof, epoxy resin, acrylate resin or copolymers thereof, methacrylate resin or copolymers thereof, polyurethane resin, polyamide resin, polyvinyl butyral resin, styrene-butadiene latex, and the like.

(Other Components)

Other components that can be used in the recording layer will be described hereinafter.

Such other components can be appropriately selected, without particular limitation, in accordance with a purpose. Examples thereof include known additives such as a thermally-meltable material, an ultraviolet absorber, and an antioxidant.

The amount of each of such other components to be applied is preferably from about 0.05 to 1.0 g/m$^2$, more preferably from about 0.1 to 0.4 g/m$^2$. Such components may be included in the inside and/or the outside of the microcapsules.

The thermally-meltable material can be included in the recording layer in order to improve the thermal responsiveness thereof.

Examples of the thermally-meltable material include am aromatic ether, a thioether, an ester, an aliphatic amide and an ureido. Examples of these compounds are described in, for example, JP-A Nos. 58-57989, 58-87094, 61-58789, 62-109681, 62-132674, 63-151478, 63-235961, 2-184489 and 2-215585, the disclosures of which are incorporated by reference herein.

Preferable examples of the ultraviolet ray absorber include benzophenone ultraviolet ray absorbers, benzotriazole ultraviolet ray absorbers, salicylic acid ultraviolet ray absorbers, cyanoacrylate ultraviolet ray absorbers, and oxalic acid anilide ultraviolet ray absorbers. Examples thereof are described in JP-A Nos. 47-10537, 58-111942, 58-212844, 59-19945, 59-46646, 59-109055 and 63-53544, Japanese Patent Application Publication (JP-B) Nos. 36-10466, 42-26187, 48-30492, 48-31255, 48-41572, 48-54965 and 50-10726, and U.S. Pat. Nos. 2,719,086, 3,707,375, 3,754,919 and 4,220,711, the disclosures of which are incorporated by reference herein.

Examples of the antioxidant include hindered amine antioxidants, hindered phenol antioxidants, aniline antioxidants, and quinoline antioxidants. Examples thereof are described in, for example, JP-A Nos. 59-155090, 60-107383, 60-107384, 61-137770, 61-139481 and 61-160287, the disclosures of which are incorporated by reference herein.

It is preferable that the recording layer is applied such that a solid application amount thereof after application and drying will be from 1 to 25 g/m$^2$ and the thickness of the recording layer will be 1 to 25 μm. A plurality of such recording layers may be provided. In this case, the solid application amount of all the recording layers is preferably from 1 to 25 g/m$^2$ <Protective Layer>

The recording material that is used in the invention has a protective layer as an uppermost layer at the recording layer side of the material. Usually, the protective layer is formed by applying a coating liquid for the protective layer.

(Pigment)

The pigment that is used in the protective layer may be an organic pigment or an inorganic pigment.

The average particle diameter of the pigment that is used in the protective layer is preferably from 0.10 to 5.00 μm, wherein the "average particle diameter" refers to the 50%-volume average particle diameter measured by the laser diffraction method (that is, the particle diameter at which the cumulative volume distribution of the particles reaches 50%, this diameter being measured with a laser diffraction particle diameter distribution meter (trade name: LA700, manufactured by Horiba Ltd.) and being referred to merely as the "average particle diameter" on occasion hereinafter). The 50%-volume average particle diameter is more preferably from 0.20 to 0.50 μm. When this 50%-volume average particle diameter is within a range of 0.10 to 5.00 μm, the haze value can be decreased.

The kind of the pigment that can be used in the protective layer is not particularly limited, and any known inorganic or organic pigments can be used. Preferable examples thereof include inorganic pigments such as calcium carbonate, titanium oxide, kaolin, aluminum hydroxide, amorphous silica and zinc oxide, and organic pigments such as urea formalin resin and epoxy resin. As the pigment that is used in the protective layer, inorganic pigments are preferable, and in particular kaolin, aluminum hydroxide and amorphous silica are more preferable. These pigments may be used alone or in combination of two or more kinds thereof. The surface of the pigment may be coated with at least one selected from the group consisting of higher fatty acids, metal salts of higher fatty acids and higher alcohols. Examples of the higher fatty acid include stearic acid, palmitic acid, myristic acid and lauric acid.

As mentioned above, the pigment that is used in the protective layer is preferably an inorganic pigment. The content of the inorganic pigment is preferably not more than 20% by mass and more preferably not more than 10% by mass based on the total solid content of the protective layer, and further preferably no pigment is contained in the protective layer.

The inorganic pigment is preferably used after the pigment is finely dispersed so as to have a 50%-volume average particle diameter of 0.10 to 5.00 μm. The dispersing is preferably conducted by a known dispersing machine such as a dissolver, a sand mill or a ball mill in the presence of a dispersing auxiliary such as sodium hexametaphosphate, partially or completely saponified polyvinyl alcohols, modified polyvinyl alcohols, polyacrylic acid copolymers and surfactants (preferably partially or completely saponified polyvinyl alcohols, itaconic acid modified polyvinyl alcohols, terminal alkyl modified polyvinyl alcohols and ammonium salts of polyacrylic acid copolymers).

(Matting Agent)

Examples of the matting agent included in the protective layer include fine particles of starch obtained from barley, wheat, corn, rice or bean; fine particles of synthetic polymers such as cellulose fibers, polystyrene resins, epoxy resins, polyurethane resins, urea formalin resins, poly(meth)acrylate resins, polymethyl(meth)acrylate resins, copolymer resins of vinyl chloride and/or vinyl acetate, and polyolefins; and fine particles of inorganic materials such as calcium carbonate, titanium oxide, kaolin, smectite clay, aluminum hydroxide, silica and zinc oxide. In order to obtain a recording material having excellent transparency, material in the form of fine particles having a refractive index of 1.45 to 1.75 is preferable. The average particle diameter thereof is preferably from 1 to 20 μm, more preferably from 1 to 10 μm.

The protective layer preferably has a surface scratch hardness of 40 g or more as specified in JIS K 6718, the disclosure of which is incorporated by reference herein, in order to prevent coating film peeling when cutting or damage when handling. In the invention, the surface scratch hardness is tested by using a continuous gravitational scratch strength testing machine, scratching the protective layer surface with a sapphire conical scratch needle (tip radius: 0.1 mm) while continuously changing the weight in a range of 0 to 200 g in the moving distance of 100 mm, forming color to have a transmission density of 1.2, observing under transmitted light, and determining the scratch hardness from the moving distance at which the density is changed by scratch.

(Binders)

The protective layer contains a binder. As the binder, polyvinyl alcohol is preferably used from the viewpoint of excellent transparency and water resistance, and other examples include a carboxy modified polyvinyl alcohol, a silica modified polyvinyl alcohol, and other modified polyvinyl alcohols.

In the invention, the content of the binder in the protective layer is preferably 50% by mass or more, more preferably 55 to 99% by mass, and further preferably 60 to 99% by mass based on the total solid content of the protective layer.

A known film hardener or the like is preferably contained in the protective layer. Examples of the film hardener include inorganic compounds such as boric acid, borax and colloidal silica, and aldehyde derivatives and dialdehyde derivatives.

In the invention, it is preferable to add 2,3-dihydroxy-1,4-dioxanes to the protective layer as a film hardener, because the film strength is increased and the water resistance of the protective layer is improved. Examples of 2,3-dihydroxy-1,4-dioxanes include 2,3-dihydroxy-5-methyl-1,4-dioxane (compound represented by the following formula [002]), 2,3-dihydroxy-1,4-dioxane, 2,3-dihydroxy-5,6-dimethyl-1,4-dioxane, 2,3-dihydroxy-2,5,6-trimethyl-1,4-dioxane, and 2,3-dihydroxy-2-methyl-1,4-dioxane.

These 2,3-dihydroxy-1,4-dioxanes are preferably added in an amount of 0.1 to 200% by mass, more preferably 1 to 100% by mass, further preferably 10 to 50% by mass, and particularly preferably 20 to 40% by mass based on the content of the binder in the layer.

[002]

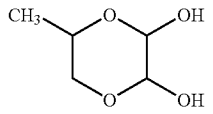

In the invention, in order to form a protective layer uniformly on a recording layer or intermediate layer, it is preferred to add a surfactant to a coating solution for forming a protective layer. The surfactant is preferably an alkali metal salt of a sulfosuccinic acid, or a fluorine containing surfactant, and specific examples include sodium, potassium or ammonium salts of di-(2-ethylhexyl) sulfosuccinic acid or di-(n-hexyl) sulfosuccinic acid; acetylene glycol derivatives; sodium, potassium or ammonium salts of a perfluoroalkyl sulfate; and perfluoroalkyl betaine compounds.

Further, in the protective layer, metal oxide fine particles, inorganic electrolytes, or polymer electrolytes may be added for prevention of static charge of the recording material. The protective layer may have a single layer structure or a laminated structure of plural layers.

The dry coating amount of the protective layer is preferably 0.2 to 7 g/m$^2$, more preferably 1 to 4 g/m$^2$.

<Support>

The support of the recording material that is used in the invention preferably has a thermal shrinkage rate in a length direction and a width direction of less than 1%, more preferably 0.5% or less in order to effectively prevent deformation such as curling. By using a support having a small thermal shrinkage rate, thermal shrinkage of the support can be suppressed, even when used, for example, in a medical recording purpose or when a high thermal energy is applied, whereby curling deformation after recording can be prevented.

The support in the invention is preferably a support having a small thermal shrinkage rate as mentioned above, which may be properly selected from known supports, and in particular a polymer film is preferred. Examples of transparent supports include synthetic polymer films. Specific examples include polyester films such as a polyethylene terephthalate, polybutylene terephthalate or polyethylene naphthalate film; a cellulose triacetate film; and polyolefin films such as a polypropylene or polyethylene film. In particular a polyethylene terephthalate (PET) film is preferred. These may be used alone, or laminated and then used. The thickness of the synthetic polymer film is preferably 10 to 200 μm, more preferably 15 to 150 μm, and further preferably 20 to 100 μm. When the thickness of the synthetic polymer film is 10 to 200 μm, film conveying and handling are easy, and the label is hardly peeled if attached to a solid object.

The synthetic polymer film is preferably transparent, or may be colored in a desired hue. Examples of the coloring method of the synthetic polymer film include a method of forming a film by kneading dye in resin before forming a resin film; and a method of coating a colorless transparent resin film with a coating liquid prepared by dissolving a dye in a proper solvent by a known coating method such as a gravure coating method, a roller coating method and a wire coating method. In particular, a preferable film is a film prepared by conducting a heat resistance treatment, a drawing treatment, or an antistatic treatment on a film formed from a polyester resin, such as polyethylene terephthalate (PET) and polyethylene naphthalate, that is kneaded with a blue dye. A polyethylene terephthalate film having a thickness of 20 to 100 μm is particularly preferred for the support in the invention.

On the other hand, the support is preferably composed of a foamed polyethylene terephthalate. When the support is composed of a foamed polyethylene terephthalate, the heat generated by irradiation of a $CO_2$ laser described later is hardly lost, and the printing density can be improved.

<Back Layer>

In the recording material used in the invention, in order to improve the curl balance, it is preferred to form a back layer containing at least one water soluble binder layer at the opposite side (back side) of the color forming face having a recording layer or an intermediate layer of the support. The coating amount of the water soluble binder on the back side is preferably 0.5 to 5 g/m$^2$ and more preferably 1.5 to 4 g/m$^2$ in order to further improve the curl balance.

As the water soluble binder used in the back layer in the invention, gelatins are preferred, and in particular an alkali treated gelatin that is low in isoelectric point, and a dielectric gelatin reacted with an amino group (for example, phthalic gelatin) are preferred.

The water soluble binders used in the back layer in the invention may be used either alone or in combination of plural types. When the back layer is formed of plural layers, at least two layers thereof preferably contain gelatin, and other water soluble binders may be contained together with gelatin.

The recording material used in the invention may further contain a latex at the back side in order to improve the curl balance, and in this case the coating amount of the latex preferably does not exceed the coating amount of gelatin at the back side. To further improve the curl balance, the coating amount of the latex at the back side preferably does not exceed 50% by mass of the coating amount of gelatin at the back side. The latex is preferably used in a form of a water dispersion liquid.

The latex is considered to act as a filler of gelatin, and it suppresses thermal expansion and shrinkage of gelatin film, and functions to improve dimensional stability. On the other hand, when the coating ratio of the latex to gelatin becomes higher, the gelatin film is plasticized, so that adhesion resistance becomes poor. In particular, when the coating mass of the latex after applying and drying exceeds the gel coating mass at the back surface, the adhesion property of the back surface and the color forming surface is increased, whereby film may be easily peeled when both the surfaces are separated, which is unsuitable for practical use. To avoid such a trouble, the latex coating amount preferably does not exceed the gelatin coating amount at the back side, and in particular does not exceed 50% by mass of the coating amount of gelatin at the back side.

A copolymer of various monomers is preferred as the latex used in the invention. Examples of the monomers include alkyl acrylates such as methyl acrylate, ethyl acrylate, propyl acrylate and butyl acrylate; alkyl methacrylates such as methyl methacrylate, ethyl methacrylate, propyl methacrylate and butyl methacrylate; hydroxyethyl methacrylate, acrylic acid, and styrenes. These copolymers may be used either alone or in combination of plural types.

The back layer in the invention may be formed of either one layer or plural layers. In particular, it is preferably composed of plural layers because the coating film can be favorably formed while increasing the coating amount of the water soluble binder containing gelatin without causing any other problems. If necessary or depending on the purpose, the back layer may also contain other additives, such as film hardeners, matting agents, ultraviolet absorbers, dyes, pH regulators, preservatives, and surfactants.

Examples of the water-soluble binder that is used in the back layer include: water-soluble polymers such as vinyl acetate-acrylamide copolymer, polyvinyl alcohols (such as silicon-modified polyvinyl alcohol, acetyl-modified polyvinyl alcohol, and fluorinated acetyl-modified polyvinyl alcohol), starch, modified starch, methylcellulose, carboxymethylcellulose, hydroxymethylcellulose, gum arabic, casein, styrene-maleic acid copolymer hydrolyzates, styrene-maleic acid copolymer half-ester hydrolyzates, isobutyrene-maleic anhydride copolymer hydrolyzates, polyacrylamide derivatives, polyvinyl pyrrolidone, sodium polystyrenesulfonate, and sodium alginate; and water-insoluble polymers such as styrene-butadiene rubber latex, acrylonitrile-butadiene rubber latex, methyl acrylate-butadiene rubber latex, and vinyl acetate emulsion.

The back layer may further contain a hardening agent for reacting with the water-soluble binder (in particular, gelatin) to harden the film and give water resistance to the film. Examples of the hardening agent include the agents described in "THE THEORY OF THE PHOTOGRAPHIC PROCESS FOURTH EDITION" (written by T. H. James), pp. 77-87, the disclosure of which is incorporated by reference herein. Among them, vinylsulfone compounds are preferable.

The back layer may further contain a matting agent in order to improve the transporting property of the recording material and provide an antireflection property to the recording material.

Examples of the matting agent that is used in the back layer include fine particles of starch obtained from barley, wheat, corn, rice or bean; fine particles of synthetic polymers such as cellulose fibers, polystyrene resins, epoxy resins, polyurethane resins, urea formalin resins, poly(meth)acrylate resins, polymethyl(meth)acrylate resins, copolymer resins of vinyl chloride and/or vinyl acetate, and polyolefins; and fine particles of inorganic materials such as calcium carbonate, titanium oxide, kaolin, smectite clay, aluminum hydroxide, silica and zinc oxide. In order to obtain a recording material having excellent transparency, material in the form of fine particles having a refractive index of 1.45 to 1.75 is preferable. The average particle diameter thereof is preferably from 1 to 20 μm, more preferably from 1 to 10 μm.

It is preferable that the back layer, which is at the opposite side to the recording layer from the support and is an uppermost layer, includes a fluorine-type surfactant as a coating auxiliary or an antistatic agent.

Examples of the fluorine-type surfactant include potassium perfluorooctanesulfonate, N-propyl-N-oxyethylene perfluorooctanesulfonamide, sodium butylsulfonate, trimethyl(propyleneaminosulfonylperfluorooctane)ammonium chloride, and sodium N-propyl-N-oxyethyleneperfluorooctanesulfonate.

A coating solution for forming a back layer may include a thickener for adjusting the viscosity thereof so as to make the application of the coating solution easier. An ultraviolet ray absorber may be added to the coating solution in order to heighten the light fastness of recorded images. The thickener or the ultraviolet ray absorber can be appropriately selected from known thickeners or ultraviolet absorbers.

In order to maintain the stability of a coating solution for forming the back layer, a pH adjusting agent capable of adjusting pH, such as sodium hydroxide, may be added thereto. A preservative may be added to the back layer in order to prevent deterioration of a coating solution for forming the back layer and deterioration of the recording material. The preservative can be appropriately selected from known preservatives.

When a plurality of such back layers are provided, each of the above optional components may be included in any layer(s). The optional components may be appropriately contained as far as the advantageous effects of the invention are retained.

The coating method for providing the back layer may be a known coating method, such as blade coating, air-knife coating, gravure coating, roll coating, spray coating, dip coating, or bar coating. When a plurality of such back layers are provided, the layers may be provided by simultaneous multilayer coating by an extrusion die method or the like.

The side of the support opposite to the recording layer may have not only the back layer but also a layer that contains polyvinyl alcohol and is adjacent to the back layer (hereinafter referred to as a "PVA layer" on occasion) since the behavior of the recording material before the extent of curl reaches an equilibrium immediately after an image is printed can be controlled. The PVA layer is provided on the side of the support having the back layer, and may be provided on the surface of the back layer which is farthest from the support or may be provided between the support and the back layer. If a plurality of such back layers are provided, the PVA layer may be provided between the back layers. A plurality of such PVA layers may be provided.

Preferable examples of the polyvinyl alcohol in the PVA layer include completely-saponificated polyvinyl alcohol, carboxy-modified polyvinyl alcohol, and silica-modified polyvinyl alcohol.

The content of the polyvinyl alcohol in the PVA layer is preferably from 50 to 100% by mass of the solid content in the layer.

The PVA layer may further contain a surfactant. Examples of the surfactant include sodium alkylbenzenesulfonate, sodium alkylsulfate, sodium dioctylsulfosuccinate, and polyalkylene glycol.

In the same manner as in the case of the back layer, the PVA layer can be provided by applying a coating solution including polyvinyl alcohol. The thickness of this layer is preferably from 0.5 to 10 μm.

<Other Layers>

In the present invention, at any position on the support, for the purpose of preventing fading of the image, an ultraviolet ray filter layer may be provided. The ultraviolet ray filter layer contains an ultraviolet ray absorber such as benzotriazole compounds, benzophenone compounds and hindered amine compounds.

Further, an antireflection layer may be provided. The antireflection layer can be formed by a mixture containing particles that are usable in the back layer as a preferable matting agent.

In order to prevent the peeling of the recording layer from the support, an undercoat layer may be provided on the support before the recording layer, the protective layer and the like are provided on the support.

The undercoat layer may comprise at least one selected from acrylic ester copolymers, polyvinylidene chloride, SBR, aqueous polyesters and the like. The thickness thereof is preferably from 0.05 to 0.5 μm.

When the recording layer is applied on the undercoat layer, the undercoat layer may swell by water contained in the coating solution for forming the recording layer so that the image recorded in the recording layer may deteriorate. It is therefore preferable to use a hardening agent such as a dialdehyde (such as glutaraldehyde or 2,3-dihydroxy-1,4-dioxane) or boric acid to harden the layer. The amount of the hardening agent to be added may be appropriately determined within the range of 0.2 to 3.0% by mass based on the dry mass of the undercoat layer in accordance with a desired hardness.

The recording material used in the invention may be manufactured, for example, in the following procedure, but the method is not limited thereto. At one side of a support, a coating liquid for forming a recording layer (hereinafter referred to as a "recording layer coating liquid") is applied to form a recording layer, and a intermediate layer coating liquid and a protective layer coating liquid are applied to form the respective layers on the recording layer, and at the opposite side, as mentioned above, a back layer of one layer or plural layers is formed by applying a back layer coating liquid, and further as required, other layers are formed on one side or the other side. The specific coating method at one side is same as the coating method for applying and forming the back layer.

Herein, the recording layer, intermediate layer, and protective layer may be formed at the same time, and in such a case, the recording layer coating liquid, the intermediate layer coating liquid and the protective layer coating liquid are applied simultaneously in plural layers on the support.

The recording method of the invention is a method of recording an image on the above-mentioned recording material by irradiating a $CO_2$ laser having a wavelength of 9 to 11 μm. The wavelength of the $CO_2$ laser to be irradiated is preferably 9.6 to 10.7 μm, more preferably 10.5 to 10.6 μm. By irradiating a $CO_2$ laser having a wavelength of 9 to 11 μm, an image of high printing density can be recorded.

The $CO_2$ laser is not particularly limited, as far as a $CO_2$ laser light having a wavelength of 9 to 11 μm can be irradiated, and may be properly selected depending on the purpose, and a commercial laser can be used. Examples include BLAZAR 6000 manufactured by LaserTechnics, Inc., Unimark manufactured by Ushio Inc., Zymark 7000 manufactured by Coherent, Inc., ML-9110 manufactured by Keyence, Smart Rays 110 manufactured by EDM CORP., and Domino Scanning Laser manufactured by Cornes Dodwell.

The $CO_2$ laser is preferably irradiated while adjusting such that the energy on the recording material surface is 10 to 200 $mJ/mm^2$. More preferably, the energy on the recording material surface is 10 to 150 $mJ/mm^2$. If the energy by the $CO_2$ laser is less than 10 $mJ/mm^2$, sufficient color-forming may not be achieved, or if exceeding 200 $mJ/mm^2$, ablation may occur and the colored recording layer may be lost.

EXAMPLES

The invention is specifically described below by presenting examples, but the invention is not limited to these examples alone. In the example, the unit "%" refers to "% by mass" unless otherwise specified.

Example 1

(Preparation of Protective Layer Coating Liquid)

<Preparation of Pigment Dispersion Liquid for Protective Layer>

To 100 g of water, 30 g of a stearic acid surface treatment aluminum hydroxide (Heizilight H42S, manufactured by Showa Denko) was added as a pigment, and the mixture was stirred for 3 hours, and to this, 0.8 g of 40% aqueous solution of dispersion auxiliary (Poise 532A, manufactured by Kao), 10 g of 9.4% aqueous solution of polyvinyl alcohol (PVA105, manufactured by Kuraray), and 10 g of aqueous solution of a compound represented by the following formula [100] adjusted to 2% were added and dispersed by a sand mill, and water was added to adjust the solid concentration to 18.5%, whereby a pigment dispersion liquid for a protective layer containing a pigment for a protective layer with an average particle diameter of 0.30 μm was obtained.

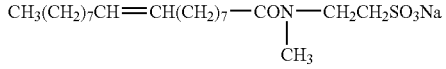

[100]

<Preparation of Protective Layer Coating Liquid>

In 83 g of water, 90 g of 8% aqueous solution of polyvinyl alcohol (trade name: PVA124C, manufactured by Kuraray), 10 g of 4% aqueous solution of boric acid, 30.3 g of the pigment dispersion liquid for protective layer (solid content: 18.5%), 3.2 g of 10% aqueous solution of dodecyl benzene sulfonic acid Na salt, 1.6 g of 75% aqueous solution of ammonium salt of di-2-ethyl hexyl sulfosuccinic acid (trade name: Nissan Electrol SAL1, manufactured by NOF Corp.), 16 g of 10% aqueous solution of Surflon S131S (manufactured by Asahi Glass Co., Ltd), 1.1 g of Prisurf A217E (manufactured by Daiichi Kogyo Seiyaku Co., Ltd), and 8 g of 2% aqueous solution of acetic acid were added and mixed, whereby a coating liquid for protective layer was obtained.

(Preparation of Recording Layer Coating Liquid)

<Preparation of Coating Liquid Containing Microcapsules>

21.0 g of 2-anilino-3-methyl-6-diethyl amino fluorane was added to 21.0 g of ethyl acetate, heated to 70° C. and dissolved, and cooled to 45° C. To this, 16.6 g of capsule wall material (Takenate D110N, manufactured by Takeda Pharmaceutical Co., Ltd.) was added and mixed. This solution was added to the water phase of 16.6 g of water and 48.1 g of 8% polyvinyl alcohol (MP-103, manufactured by Kuraray), and emulsified and dispersed for 5 minutes at 15000 rpm by using Ace Homogenizer (manufactured by Nippon Seiki Co., Ltd.). In the obtained emulsion, 112 g of water was added, and an encapsulating reaction was conducted for 4 hours at 60° C., whereby a coating liquid containing microcapsules having an average particle diameter of 0.3 μm was prepared.

<Preparation of Emulsion Dispersion Liquid of Electron Accepting Compound>

As an electron accepting compound, 22.0 g of a compound represented by the following formula [301], 8.0 g of a compound represented by the following formula [302], 2.6 g of a compound represented by the following formula [303], 2.6 g of a compound represented by the following formula [304], and 0.5 g of a compound represented by the following formula [305], and as an ultraviolet absorber, 4.0 g of a compound represented by the following formula [306] were added to 16.5 g of ethyl acetate, together with 1.0 g of tricrensyl phosphate and 0.5 g of diethyl maleate, and heated to 70° C. and dissolved. This solution was added to a water phase of 67 g of water, 55 g of 8% aqueous solution of polyvinyl alcohol (PVA217C, manufactured by Kuraray), 19.5 g of 15% aqueous solution of polyvinyl alcohol (PVA205C, manufactured by Kuraray), 11 g of 2% aqueous solution of a compound represented by the following formula [401], and 11 g of 2% aqueous solution of a compound represented by the following formula [402], and emulsified and dispersed at 10000 rpm by using Ace Homogenizer (manufactured by Nippon Seiki Co., Ltd.) until the average particle diameter became 0.7 μm, whereby an emulsion of electron accepting compound was obtained.

[301]

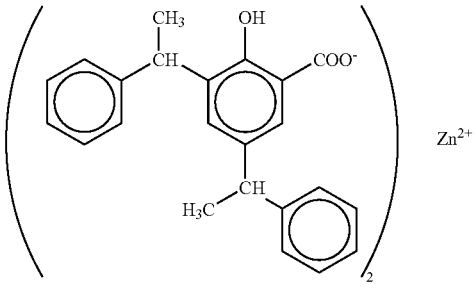

[302]

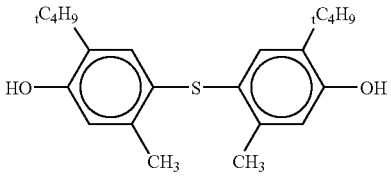

[303]

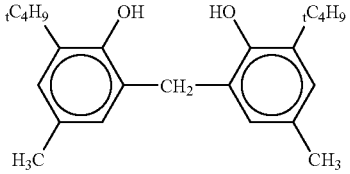

[304]

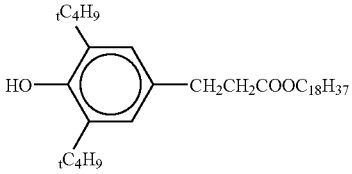

[305]

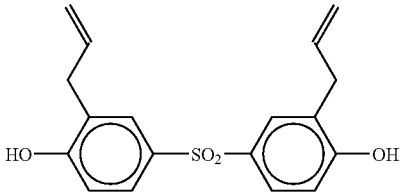

[306]

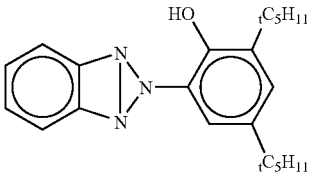

[401]

$C_{12}H_{25}SO_3Na$

[402]

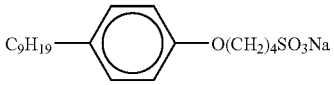

<Preparation of Recording Layer Coating Liquid>

A recording layer coating liquid was prepared by mixing 27.0 g of the coating liquid containing microcapsules (solid content concentration: 23%), 100 g of the emulsion dispersion liquid of electron accepting compound (solid content concentration: 22%), 4.5 g of colloidal silica (Snowtecs, manufactured by Nissan Chemical Industries, Ltd.), 1.2 g of 50% aqueous solution of a compound represented by the formula [002], and 14.5 g of water.

<Preparation of Recording Layer>

On one side of a transparent polyethylene terephthalate (PET) support having a thickness of 60 μm, the recording layer coating liquid and the protective layer coating liquid were simultaneously applied in this order (simultaneous double-layer coating), in a coating amount of 50 ml/m$^2$ and 26 ml/m$^2$, respectively, by a slide bead method, and then dried, whereby a recording layer and a protective layer were formed on the support. At this time, the coating liquid temperature of each layer was adjusted in a range of 33° C. to 37° C. The drying condition was as follows. The coating speed was 160 m/min, the spacing between the coating die tip and the support was 0.10 to 0.30 mm, and the pressure in the decompression chamber was lower than the atmospheric pressure by 200 to 1000 Pa. Electricity of the support was removed by ion wind before coating. In a subsequent initial drying zone, the support was dried with a wind of a temperature of 45° C. to 55° C. and a dew point of 0 to 5° C., and was conveyed without contact, and dried by a spiral contact-free drying device with a drying wind of a dry bulb temperature of 30 to 45° C. and a wet bulb temperature of 17 to 23° C., and adjusted to a temperature of 25° C. and a humidity of 40 to 60% after drying.

<Attaching of Adhesive Layer and Release Paper>

On the surface of the support having a recording layer and a protective layer, at the side without a recording layer and a protective layer, an acrylic adhesive (Saibinol X-491-286E, manufactured by Saiden Chemical Industry Co., Ltd.) was applied and dried in an amount of a dry weight of 15 g/m$^2$ using a roll coater, and a release side of release paper was adhered onto the layer of the adhesive, whereby a recording material of example 1 (laser marking material) was obtained. Onto the protective layer of the obtained recording material, a carbon dioxide ($CO_2$) laser (BLAZAR 6000, manufactured by LaserTechnics, Inc.) was applied at a wavelength of 10.6 μm such that the energy on the surface of the protective layer of the recording material was 40 mJ/mm$^2$, whereby printing was carried out.

Example 2

A recording material of example 2 was obtained in the same procedure as in example 1, except that the amount of water was changed from 83 g to 125 g, and that the pigment dispersion liquid for protective layer (solid content: 18.5%) and 75% aqueous solution of ammonium salt of di-2-ethyl hexyl sulfosuccinic acid (Nissan Electrol SAL1, manufactured by NOF Corp.) were not used in the process of <Preparation of protective layer coating liquid> in example 1. Also same as in example 1, a carbon dioxide laser was applied onto the protective layer of the obtained recording material, whereby printing was carried out.

Example 3

A recording material of example 3 was obtained in the same procedure as in example 1, except that the amount of water was changed from 83 g to 125 g, that the pigment dispersion liquid for protective layer (solid content: 18.5%) and 75% aqueous solution of ammonium salt of di-2-ethyl hexyl sulfosuccinic acid (Nissan Electrol SAL1, manufactured by NOF Corp.) were not used in the process of <Preparation of protective layer coating liquid> in example 1, and that a capsule wall material (Takenate D140N, manufactured by Takeda Pharmaceutical Co., Ltd., containing 50% or more isophorone diisocyanate trimer) was used instead of the capsule wall material (Takenate D110N, manufactured by Takeda Pharmaceutical Co., Ltd.) in the process of <Preparation of coating liquid containing microcapsules> in example 1. Also same as in example 1, a carbon dioxide laser was applied onto the protective layer of the obtained recording material, whereby printing was carried out.

Example 4

A recording material of example 4 was obtained in the same procedure as in example 3, except that crystal violet lactone was used instead of 2-anilino-3-methyl-6-diethyl amino fluorane in the process of <Preparation of coating liquid containing microcapsules> in example 3. Also same as in example 1, a carbon dioxide laser was applied onto the protective layer of the obtained recording material, whereby printing was carried out.

Example 5

A recording material of example 5 was obtained in the same procedure as in example 3, except that polypropylene having a thickness of 60 μm was used instead of the transparent polyethylene terephthalate (PET) support having a thickness of 60 μm in the process of <Preparation of recording layer> in example 3. Also same as in example 1, a carbon dioxide laser was applied onto the protective layer of the obtained recording material, whereby printing was carried out.

Example 6

A recording material of example 6 was obtained in the same procedure as in example 3, except that a white foamed PET having a thickness of 60 μm was used instead of the transparent polyethylene terephthalate (PET) support having a thickness of 60 μm in the process of <Preparation of recording layer> in example 3. Also same as in example 1, a carbon dioxide laser was applied onto the protective layer of the obtained recording material, whereby printing was carried out.

Example 7

A recording material of example 7 was obtained in the same procedure as in example 1, except that the protective layer coating liquid was replaced with a protective layer coating liquid B prepared in the following procedure. Also same as in example 1, a carbon dioxide laser was applied onto the protective layer of the obtained recording material, whereby printing was carried out.

<Preparation of Protective Layer Coating Liquid B>

To 83 g of water, 90 g of 8% aqueous solution of polyvinyl alcohol (PVA124C, manufactured by Kuraray), 10 g of 4% aqueous solution of boric acid, 61.6 g of the pigment dispersion liquid for protective layer (solid content: 18.5%), 6.5 g of 10% aqueous solution of dodecyl benzene sulfonic acid Na salt, 3.28 g of 75% aqueous solution of ammonium salt of di-2-ethyl hexyl sulfosuccinic acid (Nissan Electrol SAL1, manufactured by NOF Corp.), 17.5 g of 6% aqueous solution of styrene-maleic acid copolymer ammonium salt (Polymalon 385, manufactured by Arakawa Chemical), 14 g of 20% aqueous solution of colloidal silica (Snowtecs, manufactured by Nissan Chemical Industries, Ltd.), 16 g of 10% aqueous solution of Surflon S131S (manufactured by Asahi Glass Co., Ltd), 1.1 g of Prisurf A217E (manufactured by Daiichi Kogyo Seiyaku Co., Ltd), and 8 g of 2% aqueous solution of acetic acid were added and mixed, whereby protective layer coating liquid B was prepared.

Comparative Example 1

Onto the protective layer of the recording material obtained in example 2, a GaAs junction laser was applied at a wavelength of 780 nm such that the energy on the surface of the protective layer of the recording material was 40 mJ/mm$^2$, whereby printing was carried out.

[Evaluation of Laser Printing Density]

In examples 1 to 7 in which printing was carried out by a carbon dioxide ($CO_2$) laser, and comparative example 1 in which printing was carried out by a GaAs junction laser, the laser printing density was visually evaluated by the following criterion. Results are shown in Table 1.

Criterion

D: The printed mark is unclear.

C: The printed mark is clear, but the density of the formed color is low due to the cloudiness of the coating film.

B: The printed mark is clear, and the density of the formed color is high.

A: The printed mark is clear, and the density of the formed color is very high.

[Evaluation of Solvent Resistance]

On the protective layer in the print area of each recording material obtained in examples 1 to 7 and comparative example 1, 100 μl of methyl ethyl ketone was dropped, dried naturally in an environment of 25° C. and 50%, and the solvent resistance was visually evaluated by the following criterion. Results are shown in Table 1.

Criterion

D: The methyl ethyl ketone dropped part is colored or clouded, so that the printed mark cannot be identified.

C: The methyl ethyl ketone dropped part is colored or clouded, but the printed mark can be identified.

B: The methyl ethyl ketone dropped part is slightly colored or clouded, but no problem.

A: The methyl ethyl ketone dropped part is neither colored nor clouded.

[Evaluation of Heat Resistance]

Each recording material obtained in examples 1 to 7 and comparative example 1 was kept in an atmosphere of 120° C. for 30 minutes, and then the optical reflection density was observed by a MacBeth reflection densitometer (RD-918, manufactured by MacBeth). Results are shown in Table 1. The lower the optical reflection density, the higher is the heat resistance.

TABLE 1

| | | Example 1 | Example 2 | Example 3 | Example 4 | Example 5 | Example 6 | Example 7 | Comparative Example 1 |
|---|---|---|---|---|---|---|---|---|---|
| Protective layer | Total solid content (g) | 18.1 | 11.3 | 11.3 | 11.3 | 11.3 | 11.3 | 28.2 | 11.3 |
| | Binder content (g) | 7.4 | 7.2 | 7.2 | 7.2 | 7.2 | 7.2 | 7.5 | 7.2 |
| | Pigment content (g) | 5.6 | 0 | 0 | 0 | 0 | 0 | 11.4 | 0 |

TABLE 1-continued

| | | Example 1 | Example 2 | Example 3 | Example 4 | Example 5 | Example 6 | Example 7 | Comparative Example 1 |
|---|---|---|---|---|---|---|---|---|---|
| | Ratio of binder to total solid content (%) | 41 | 64 | 64 | 64 | 64 | 64 | 27 | 64 |
| | Ratio of pigment to total solid content (%) | 31 | 0 | 0 | 0 | 0 | 0 | 40 | 0 |
| | Ratio of pigment to binder (%) | 76 | 0 | 0 | 0 | 0 | 0 | 152 | 0 |
| | Type of laser | $CO_2$ | $CO_2$ | $CO_2$ | $CO_2$ | $CO_2$ | $CO_2$ | $CO_2$ | GaAs |
| Results of evaluation | Laser printing density | B | A | A | A | A | A | C | D |
| | Solvent resistance | B | A | A | A | A | A | C | A |
| | Heat resistance | 0.15 | 0.13 | 0.12 | 0.12 | 0.12 | 0.12 | 0.50 | 0.13 |

As is clear from the table 1, the laser printing density is high and the solvent resistance is excellent in examples 1 to 7.

The present invention provides at least the following embodiments 1 to 13.

1. A method of recording an image, comprising irradiating a $CO_2$ laser having a wavelength of from 9 to 11 μm onto a recording material in which a recording layer and a protective layer are provided on a support in this order, wherein the recording layer comprises at least microcapsules encapsulating a basic dye precursor, and the protective layer comprises a binder.

2. The method according to embodiment 1, wherein the content of the binder is 50% by mass or more based on the total solid content of the protective layer.

3. The method according to embodiment 1, wherein the binder comprises a polyvinyl alcohol.

4. The method according to embodiment 1, wherein the protective layer comprises an inorganic pigment and the content of the inorganic pigment is 20% by mass or less based on the total solid content of the protective layer.

5. The method according to embodiment 1, wherein a wall material of the microcapsules comprises an isophorone diisocyanate compound.

6. The method according to embodiment 1, wherein the microcapsules have an average particle diameter of from 0.3 to 12 μm.

7. The method according to embodiment 1, wherein the support is a polyester film.

8. The method according to embodiment 1, wherein the support comprises a foamed polyethylene terephthalate.

9. The method according to embodiment 1, wherein the support has a thickness of from 10 to 200 μm.

10. The method according to embodiment 1, wherein the basic dye precursor is selected from the group consisting of triphenylmethanephthalide compounds, fluorane compounds, phenothiazine compounds, indolylphthalide compounds, leuco auramine compounds, rohdamine lactam compounds, triphenylmethane compounds, triazene compounds, spiropyran compounds, fluorene compounds, pyridine compounds and pyrazine compounds.

11. The method according to embodiment 1, wherein the recording layer further comprises an electron-accepting compound.

12. The method according to embodiment 11, wherein the electron-accepting compound is selected from the group consisting of phenol compounds, organic acids or metal salts thereof, and oxybenzoic acid esters.

13. The method according to embodiment 1, wherein the $CO_2$ laser is irradiated onto the recording material such that an energy on a surface of the recording material is from 10 to 200 $mJ/mm^2$.

Therefore, according to the invention, there is provided a method of recording an image having high printing density by laser irradiation.

What is claimed is:

1. A method of recording an image, comprising irradiating a $CO_2$ laser having a wavelength of from 9 to 11 μm onto a recording material in which a recording layer and a protective layer are provided on a support in this order, wherein the recording layer comprises at least microcapsules encapsulating a basic dye precursor, and the protective layer comprises a binder.

2. The method according to claim 1, wherein the content of the binder is 50% by mass or more based on the total solid content of the protective layer.

3. The method according to claim 1, wherein the binder comprises a polyvinyl alcohol.

4. The method according to claim 1, wherein the protective layer comprises an inorganic pigment and the content of the inorganic pigment is 20% by mass or less based on the total solid content of the protective layer.

5. The method according to claim 1, wherein a wall material of the microcapsules comprises an isophorone diisocyanate compound.

6. The method according to claim 1, wherein the microcapsules have an average particle diameter of from 0.3 to 12 μm.

7. The method according to claim 1, wherein the support is a polyester film.

8. The method according to claim 1, wherein the support comprises a foamed polyethylene terephthalate.

9. The method according to claim 1, wherein the support has a thickness of from 10 to 200 μm.

10. The method according to claim 1, wherein the basic dye precursor is selected from the group consisting of triphenylmethanephthalide compounds, fluorane compounds, phenothiazine compounds, indolylphthalide compounds, leuco auramine compounds, rohdamine lactam compounds, triphenylmethane compounds, triazene compounds, spiropyran compounds, fluorene compounds, pyridine compounds and pyrazine compounds.

11. The method according to claim 1, wherein the recording layer further comprises an electron-accepting compound.

12. The method according to claim 11, wherein the electron-accepting compound is selected from the group consisting of phenol compounds, organic acids or metal salts thereof, and oxybenzoic acid esters.

13. The method according to claim 1, wherein the $CO_2$ laser is irradiated onto the recording material such that an energy on a surface of the recording material is from 10 to 200 $mJ/mm^2$.

* * * * *